US011268178B2

(12) United States Patent
Park et al.

(10) Patent No.: US 11,268,178 B2
(45) Date of Patent: Mar. 8, 2022

(54) MAGNESIUM ALLOY SHEET AND METHOD FOR MANUFACTURING SAME

(71) Applicant: POSCO, Pohang-si (KR)

(72) Inventors: Jun Ho Park, Pohang-si (KR); Sang Hyun Kim, Pohang-si (KR); Jae Joong Kim, Pohang-si (KR); Oh-Duck Kwon, Pohang-si (KR); Hyun Bom Lee, Pohang-si (KR)

(73) Assignee: POSCO, Pohang-si (KR)

( * ) Notice: Subject to any disclaimer, the term of this patent is extended or adjusted under 35 U.S.C. 154(b) by 267 days.

(21) Appl. No.: 16/470,733

(22) PCT Filed: Dec. 21, 2017

(86) PCT No.: PCT/KR2017/015262

§ 371 (c)(1),
(2) Date: Jun. 18, 2019

(87) PCT Pub. No.: WO2018/117695

PCT Pub. Date: Jun. 28, 2018

(65) Prior Publication Data

US 2020/0087767 A1 Mar. 19, 2020

(30) Foreign Application Priority Data

Dec. 22, 2016 (KR) ..... 10-2016-0177010

(51) Int. Cl.
*C22F 1/06* (2006.01)
*B21B 1/46* (2006.01)
(Continued)

(52) U.S. Cl.
CPC ..... *C22F 1/06* (2013.01); *B21B 1/46* (2013.01); *B21B 3/00* (2013.01); *C22C 1/02* (2013.01); *C22C 23/02* (2013.01)

(58) Field of Classification Search
CPC ..... C22F 1/06; B21B 1/46; B21B 3/00; C22C 1/02; C22C 23/02; C22C 23/04
See application file for complete search history.

(56) References Cited

U.S. PATENT DOCUMENTS

2020/0370157 A1* 11/2020 Park ..... B21B 3/00
2021/0079503 A1* 3/2021 Park ..... B21B 3/003

FOREIGN PATENT DOCUMENTS

GN 1743486 A 3/2006
JP 2002-129272 A 5/2002
(Continued)

OTHER PUBLICATIONS

JP-2006016656-A, Shimizu, et al. (machine translation) (Year: 2006).*
(Continued)

*Primary Examiner* — John A Hevey
(74) *Attorney, Agent, or Firm* — Morgan, Lewis & Bockius LLP

(57) ABSTRACT

An exemplary embodiment of the present invention relates to a magnesium alloy sheet and a manufacturing method thereof. The exemplary embodiment of the present invention provides a magnesium alloy sheet including 0.5 to 2.1 wt % of Al, 0.5 to 1.5 wt % of Zn, 0.1 to 1.0 wt % of Ca, and a balance of Mg and inevitable impurities, with respect to a total of 100 wt % of the magnesium alloy sheet.

17 Claims, 6 Drawing Sheets

(51) Int. Cl.

| | |
|---|---|
| ***B21B 3/00*** | (2006.01) |
| ***C22C 1/02*** | (2006.01) |
| ***C22C 23/02*** | (2006.01) |

(56) References Cited

FOREIGN PATENT DOCUMENTS

| | | | | |
|---|---|---|---|---|
| JP | 2006-16656 | A | | 1/2006 |
| JP | 2006016656 | A | * | 1/2006 |
| JP | 2006-144059 | A | | 6/2006 |
| JP | 2011-58054 | A | | 3/2011 |
| JP | 2011-179075 | A | | 9/2011 |
| JP | 2013-7068 | A | | 1/2013 |
| KR | 2003-0044997 | A | | 6/2003 |
| KR | 10-2007-0027622 | A | | 3/2007 |
| KR | 10-2009-0120194 | A | | 11/2009 |
| KR | 20090120194 | A | * | 11/2009 |
| KR | 10-2010-0106137 | A | | 10/2010 |
| KR | 10-2012-0055304 | A | | 5/2012 |
| KR | 10-2015-0099025 | A | | 8/2015 |
| KR | 10-1585089 | B1 | | 1/2016 |
| KR | 10-1626820 | B1 | | 6/2016 |
| KR | 10-2017-0075407 | A | | 7/2017 |

OTHER PUBLICATIONS

KR-20090120194-A, Bae et al. (machine translation) (Year: 2009).*
Extended European Search Report dated Aug. 23, 2019 issued in European Patent Application No. 17882817.4.
European Office Action dated Aug. 10, 2020 issued in European Patent Application No. 17882817.4.
Japanese Office Action dated Jul. 28, 2020 issued in Japanese Patent Application No. 2019-552440.
H. Li, et al., "Deformation mechanism and texture and microstructure evolution during high-speed rolling of AZ31B Mg sheets, J. Mater. Sci," 2008, vol. 43, pp. 7148-7156.
Search Report issued in corresponding International Application No. PCT/KR2017/015262, dated Apr. 3, 2018.

* cited by examiner

Rolling material of Example 7

Magnesium sheet of Example 7

MAGNESIUM ALLOY SHEET AND METHOD FOR MANUFACTURING SAME

CROSS-REFERENCE OF RELATED APPLICATIONS

This application is the U.S. National Phase under 35 U.S.C. § 371 of International Patent Application No. PCT/KR2017/015262, filed on Dec. 21, 2017, which in turn claims the benefit of Korean Patent Application No. 10-2016-0177010, filed Dec. 22, 2016, the entire disclosures of which applications are incorporated by reference herein.

TECHNICAL FIELD

An exemplary embodiment of the present invention relates to a magnesium alloy sheet and a manufacturing method thereof.

BACKGROUND ART

Today, there are strict regulations on emissions of carbon dioxide in the international community. Accordingly, the vehicle industry is making efforts to reduce weight of a vehicle body. A most effective way to reduce vehicle body weight is to adopt lighter materials than steel, in general. An example of a lighter material is a magnesium plate. However, there are various barriers to the use of magnesium plates in the vehicle industry. A typical example of the barriers is moldability of the magnesium plate.

Specifically, since the magnesium plate has an HCP structure and its deformation mechanism at room temperature is limited, room temperature molding is impossible. Several studies have been undertaken in order to overcome this problem. Particularly, methods for overcoming this problem through processes may include a differential speed rolling method in which rolling speeds of upper and low rolling rolls are differently controlled, an equal channel angular pressing (ECAR) process, a hot rolling method in which rolling is performed at a temperature that is close to a process temperature of the magnesium plate, and the like. However, all of these processes are difficult to commercialize.

On the other hand, there are also techniques and patents to improve moldability through control of alloy components and composition. For example, a magnesium plate containing 1 to 10 wt % of Zn and 0.1 to 5 wt % of Ca may be used. However, there is a problem that it is difficult to apply a strip casting method to such an alloy. As a result, mass production is lacking, and even when casting is performed for a long time, a fusion phenomenon occurs between a cast material and a roll, thereby making casting difficult.

In another example, a highly molded magnesium alloy sheet having a limit dome height of 7 mm or more may be formed through a process improvement of a conventional alloy having 3 wt % of Al, 1 wt % of Zn, and 1 wt % of Ca. However, in the above case, there is a disadvantage that intermediate annealing is performed at least once between rolling and rolling, and thus the process cost is greatly increased.

DISCLOSURE

The present invention has been made in an effort to provide a magnesium alloy sheet and a manufacturing method thereof.

According to an exemplary embodiment of the present invention, a magnesium alloy sheet may include 0.5 to 2.1 wt % of Al, 0.5 to 1.5 wt % of Zn, 0.1 to 1.0 wt % of Ca, and a balance of Mg and inevitable impurities, with respect to a total of 100 wt % of the magnesium alloy sheet.

The magnesium alloy sheet may further include 1 wt % or less of Mn with respect to the total of 100 wt % of the magnesium alloy sheet.

The magnesium alloy sheet may have a calcium element segregated at grain boundaries.

An area fraction of a non-basal grain may be 20% or more with respect to a total area of 100% of the magnesium alloy sheet.

A microtexture of the magnesium alloy sheet may have a particle diameter of 5 to 20 μm.

The magnesium alloy sheet may have a twin texture or a second phase, and an area fraction of the twin structure or the second phase may be 0 to 30% with respect to the total area of 100% of the magnesium alloy sheet.

The magnesium alloy sheet may have an Erickson value of 4.5 mm or more at room temperature.

According to another embodiment of the present invention, a manufacturing method of a magnesium alloy sheet may include: preparing a molten alloy containing 0.5 to 2.1 wt % of Al, 0.5 to 1.5 wt % of Zn, 0.1 to 1.0 wt % of Ca, and a balance of Mg and inevitable impurities, with respect to a total of 100 wt % of the molten alloy; preparing a casting material by casting the molten alloy; preparing a rolled material by rolling the casting material; and final annealing of the rolled material.

In the preparing of the rolled material by rolling the casting material, rolling may be performed at a reduction ratio of 50% or less (excluding 0%) per rolling.

Specifically, in the preparing of the rolled material by rolling the casting material, the casting material may be rolled once, twice, or more.

More specifically, the rolling may be performed in a temperature range of 200 to 350° C.

More specifically, the preparing of the rolled material by rolling the casting material may further include intermediate annealing of the rolled material.

In the intermediate annealing of the rolled material, a number of intermediate annealing is in a range of ⅙ to ⅛. In this case, the number of intermediate annealing may be number of intermediate annealing/total number of rolling.

In the intermediate annealing of the rolled material, the intermediate annealing may be performed at a cumulative reduction ratio of 50% or more of the rolled material.

Specifically, the immediate annealing may be performed in a temperature range of 300 to 500° C.

Specifically, the immediate annealing may be performed for 30 to 600 min.

In the final annealing of the rolled material, the final annealing may be performed in a temperature range of 350 to 500° C.

Specifically, the final annealing may be performed for 30 to 600 min.

According to an exemplary embodiment of the present invention, it is possible to provide a magnesium alloy sheet having excellent moldability, and a manufacturing method thereof. It is possible to provide an effective magnesium alloy plate which is commercially mass-producible, and a manufacturing method thereof.

Specifically, excellent moldability may be achieved by controlling components and composition of a magnesium alloy, despite simplified process steps.

More specifically, a magnesium alloy sheet material having excellent moldability at room temperature may be obtained by controlling Al compositions and Ca components even while reducing the number of the intermediate annealing.

MODE FOR INVENTION

Figure 1:
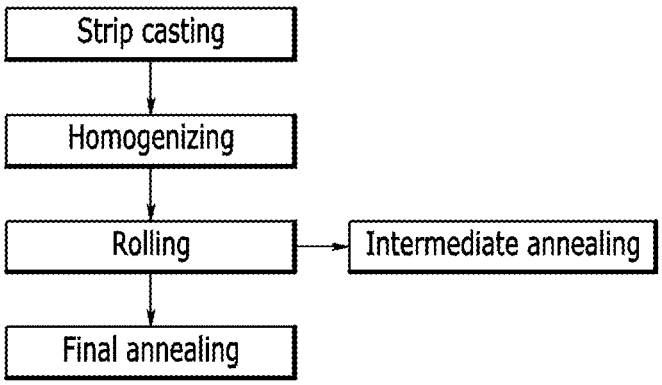
FIG. 1 illustrates a process diagram of a manufacturing method of a magnesium alloy sheet according to an exemplary embodiment of the present invention.

The advantages and features of the present invention and the methods for accomplishing the same will be apparent from the exemplary embodiments described hereinafter with reference to the accompanying drawings. However, the present invention is not limited to the exemplary embodiments described hereinafter, and may be embodied in many different forms. The following exemplary embodiments are provided to make the disclosure of the present invention complete and to allow those skilled in the art to clearly understand the scope of the present invention, and the present invention is defined only by the scope of the appended claims. Throughout the specification, the same reference numerals denote the same elements.

In some exemplary embodiments, detailed description of well-known technologies will be omitted to prevent the disclosure of the present invention from being interpreted ambiguously. Unless otherwise defined, all terms (including technical and scientific terms) used herein have the same meaning as commonly understood by one of ordinary skill in the art. In addition, throughout the specification, unless explicitly described to the contrary, the word "comprise" and variations such as "comprises" or "comprising" will be understood to imply the inclusion of stated elements but not the exclusion of any other elements. Further, as used herein, the singular forms "a", "an", and "the" are intended to include the plural forms as well, unless the context clearly indicates otherwise.

According to an exemplary embodiment of the present invention, a magnesium alloy sheet may include 0.5 to 2.1 wt % of Al, 0.5 to 1.5 wt % of Zn, 0.1 to 1.0 wt % of Ca, and a balance of Mg and inevitable impurities, with respect to a total of 100 wt % of the magnesium alloy sheet.

Specifically, the magnesium alloy sheet may further include 1 wt % or less of Mn with respect to the total of 100 wt % of the magnesium alloy sheet.

Hereinafter, reasons for limiting components and composition of the magnesium alloy sheet will be described.

Al may be included in an amount of 0.5 to 2.1 wt %.

Specifically, since aluminum plays a role of improving moldability at room temperature, casting through a strip casting method is possible. More specifically, when it is added in an amount exceeding 2.0 wt %, the moldability at room temperature may be rapidly deteriorated, and when it is added in an amount of less than 0.5 wt %, it may be difficult to expect the moldability at room temperature to be improved. More specifically, a texture changes to a strong basal texture in rolling during a rolling step of the manufacturing method of the magnesium alloy sheet to be described later. In this case, an apparatus for suppressing the change to the basal texture has a solute dragging apparatus. Such a solute dragging apparatus may deteriorate boundary mobility when heat or deformation is applied since an element such as Ca having a larger atomic radius than that of Mg is segregated in crystal grain boundaries. This may suppress basal texture from being formed by dynamic recrystallization or rolling deformation during rolling.

Therefore, when aluminum is added in an amount exceeding 2.1 wt %, an amount of the second phase of $Al_2Ca$ may increase to reduce an amount of Ca segregated in the grain boundary. As a result, the solute dragging effect may also be reduced.

On the other hand, when aluminum is added at less than 0.5 wt %, casting by the strip casting method may not be possible. Aluminum improves fluidity of molten metal, which prevents a roll sticking phenomenon during casting. Therefore, a Mg—Zn-based magnesium alloy without aluminum cannot be cast by strip casting due to the actual roll sticking phenomenon.

Hereinafter, in the present specification, a non-basal grain indicates a non-basal grain formed by a basal slip phenomenon. Specifically, magnesium has an HCP crystal structure, and it is referred to as a basal grain only when a C-axis of the HCP has a direction parallel to a thickness direction of a rolled plate. Accordingly, the non-basal grain indicates that crystal grains in all directions are not parallel to the C-axis and the thickness direction.

Zn may be included in an amount of 0.5 to 1.5 wt %.

Specifically, similar to calcium, zinc serves to improve moldability of the plate by activating the basal slip through softening of a basal plane when added. However, when zinc is added in an amount exceeding 1.5 wt %, it forms an intermetallic compound by bonding with magnesium, which may adversely affect the moldability.

Ca may be included in an amount of 0.1 to 1.0 wt %.

Similar to zinc, calcium serves to improve moldability of the plate by activating the basal slip through softening of a basal plane when added.

Specifically, in the manufacturing method of the magnesium alloy sheet to be described below, the texture has a characteristic of being changed into a strong base bottom aggregate structure upon rolling. An apparatus for suppressing the characteristic has a solute dragging apparatus. In this case, such a solute dragging apparatus may deteriorate boundary mobility when heat or deformation is applied since an element having a larger atomic radius than that of Mg is segregated in crystal grain boundaries. In this case, Ca may be used as an element having a larger atomic radius than Mg. This may suppress basal texture from being formed by dynamic recrystallization or rolling deformation during rolling.

However, when it is added in an amount exceeding 1.0 wt %, the sticking phenomenon may be increased due to an increase in stickiness with a casting roll during strip casting. This may reduce the fluidity of molten metal to lower the casting, which reduces producibility.

More specifically, the magnesium alloy sheet may further contain 1 wt % or less of Mn.

Manganese forms an Fe—Mn compound to serve to reduce a content of the Fe component in the sheet. Therefore, when manganese is contained, the Fe—Mn compound may be formed as a dross or sludge in a molten alloy state before casting. This makes it possible to form a sheet having a small content of the Fe component during casting. In addition, manganese may form a second phase of $Al_8Mn_5$ together with aluminum.

This suppresses an amount of calcium consumed to increase an amount of calcium that can segregate in grain boundaries. Thus, when manganese is added, the solute dragging effect may be further improved.

Accordingly, manganese may be contained in an amount of 1 wt % or less. Specifically, when the manganese is excessively added, an Al—Mn second phase during casting may be excessive to increase an amount of solidification at the nozzle. As a result, inverse segregation in a cast material may be increased.

The magnesium alloy sheet may have a calcium element segregated at grain boundaries. In this case, the calcium element may be crystallized in a solute form rather than an intermetallic compound form.

Specifically, calcium may be solid-solved without forming a second phase with an element such as aluminum, and is segregated in the grain boundary in a solute form, thereby suppressing formation of a basal texture by reducing the boundary mobility. As a result, it is possible to provide a magnesium alloy sheet with excellent moldability at room temperature.

An area fraction of a non-basal grain may be 20% or more with respect to a total area of 100% of the magnesium alloy sheet.

As described above, according to the exemplary embodiment of the present invention, it is possible to provide a magnesium alloy sheet having excellent moldability at room temperature by suppressing formation of a basal texture and activating slip of the non-basal grain. Accordingly, an area fraction of a non-basal grain may be 20% or more with respect to a total area of 100% of the magnesium alloy sheet. Specifically, it may be 50% or more.

A substantially formation degree of the non-basal grain is known from XRD data.

Specifically, it can be determined whether a number of basal grains is large or small, through numerical values appearing in the XRD-pole figure measurement. More specifically, the greater the numerical value, the greater the number of the basal grains. The numerical value is referred to as peak intensity, and the magnesium alloy sheet according to the exemplary embodiment of the present invention may have a peak intensity value of 5 or less. In addition, when the peak intensity value is 0, this indicates that an orientation of each crystal grain is different, rather than a specific orientation group.

Accordingly, the magnesium alloy sheet according to the exemplary embodiment of the present invention may have a peak intensity value of more than 0 and 5 or less.

The number of edge cracks with respect to a length in a rolling direction of the magnesium alloy sheet may be 1 per 50 cm or less.

In the exemplary embodiment of the present invention, an edge crack indicates a groove having a depth of 5 cm formed on a surface of the magnesium alloy plate.

A microtexture of the magnesium alloy sheet may have a particle diameter of 5 to 20 μm.

The magnesium alloy sheet may have a twin texture or a second phase, and an area fraction of the twin structure or the second phase may be 0 to 30% with respect to the total area of 100% of the magnesium alloy sheet.

Specifically, although the magnesium alloy sheet may have the twin texture or the second phase, the moldability at room temperature may be improved by controlling the fraction of the texture to a minimum as in the above range.

Accordingly, the magnesium alloy sheet may have an Erickson value of 4.5 mm or more at room temperature.

In this specification, an Erickson value indicates an experimental value derived from an Ericsson test at room temperature. Specifically, the moldability of the examples and comparative examples of the present invention may also be compared with a value through the room temperature Ericsson test.

More specifically, the Erickson value indicates a height at which a sheet is deformed until a fracture occurs, when the sheet is deformed into a cup shape. Accordingly, the higher the deformation height of the magnesium alloy sheet, the greater the Ericsson number. Accordingly, the moldability may be excellent.

According to another embodiment of the present invention, a manufacturing method of a magnesium alloy sheet may include: preparing a molten alloy containing 0.5 to 2.0 wt % of Al, 0.5 to 1.5 wt % of Zn, 0.1 to 1.0 wt % of Ca, and a balance of Mg and inevitable impurities, with respect to a total of 100 wt %; preparing a casting material by casting the molten alloy; preparing a rolled material by rolling the casting material; and final annealing of the rolled material.

First, the preparing of the molten alloy containing 0.5 to 2.1 wt % of Al, 0.5 to 1.5 wt % of Zn, 0.1 to 1.0 wt % of Ca, and a balance of Mg and inevitable impurities, with respect to a total of 100 wt %, may be performed.

Specifically, in the step, 0.3 to 0.5 wt % of Mn, with respect to the total of 100 wt % of the molten alloy, may be further included.

A reason for limiting components and composition of the molten alloy is the same as the reason for limiting the components and composition of the magnesium alloy sheet, and thus a description thereof will be omitted.

Thereafter, the preparing of the casting material by casting the molten alloy may be performed.

In this case, a casting method for preparing the casting material may include methods such as die casting, direct chill casting, billet casting, centrifugal casting, tungsten casting, mold gravity casting, sand casting, strip casting, and a combination thereof. However, the present invention is not limited thereto. Specifically, it may be cast by the strip casting method. More specifically, the molten alloy may be cast at a casting rate of 0.5 to 10 mpm.

A thickness of the cast material thus produced may be in a range of 3 to 6 mm, but the present invention is not limited thereto.

Specifically, the preparing of the casting material by casting the molten alloy may include homogenizing the casting material.

The homogenizing of the casting material may be performed in a temperature range of 350 to 500° C.

Specifically, the homogenizing may be performed for 1 to 30 hours.

As such, it is possible to eliminate defects generated during casting by performing the homogenizing of the cast material depending on the above-described conditions. Specifically, since segregation and defects are mixed inside and outside of the cast magnesium sheet, cracks are likely to occur during rolling. Thus, the homogenizing may be performed to remove defects. Accordingly, defects such as edge cracks on the surface may be prevented in a rolling step to be described later by performing the homogenization heat treatment under the above conditions.

Thereafter, the preparing of the rolled material by rolling the casting material may be performed.

In the preparing of the rolled material by rolling the casting material, rolling may be performed at a reduction ratio of 50% or less (excluding 0%) per rolling. Specifically, when the reduction ratio per rolling exceeds 50%, a crack may occur during rolling.

Herein, the reduction ratio in this specification indicates a difference between a thickness of the material before passing through the rolling roll during rolling and a thickness of the material after passing through the rolling roll, divided by the thickness of the material before passing through the rolling roll, and then multiplied by 100.

Specifically, the rolling may be performed in a temperature range of 200 to 350° C.

More specifically, when rolled at less than 200° C., the temperature may be too low to cause the crack. On the other hand, when rolling at a temperature higher than 350° C., atoms are likely to be diffused at high temperatures, so segregation of grain boundaries of Ca is suppressed, which may be disadvantageous for improvement of moldability.

Specifically, the casting material may be rolled once, twice, or more.

More specifically, the preparing of the rolled material by rolling the casting material may further include intermediate annealing the rolled material.

The rolled material may be rolled at least two times, and annealing may be performed in the middle of the rolling.

The intermediate annealing may be performed at a cumulative reduction ratio of 50% or more of the rolled material. When the intermediate annealing is carried out when the cumulative reduction ratio is 50% or more, recrystallization may be generated and grown in a twin texture formed during rolling. Accordingly, the recrystallized grains may form a non-basal texture and contribute to the improvement of moldability of the magnesium alloy sheet.

The immediate annealing may be performed in a temperature range of 300 to 500° C. The immediate annealing may be performed for 30 to 600 min.

When the intermediate annealing is performed under the above conditions, a stress generated at the time of rolling may be sufficiently removed. More specifically, the stress may be relieved through recrystallization within a range not exceeding a melting temperature of the rolled material.

In the intermediate annealing of the rolled material, a frequency of intermediate annealing is in a range of ⅙ to ⅛. In this case, the frequency of intermediate annealing indicates a ratio of a number of intermediate annealing to a total number of rolling times.

Specifically, relieving stress through intermediate annealing during rolling may be necessary. However, according to the exemplary embodiment of the present invention, it is possible to effectively relieve the stress in the rolled material through a low frequency of intermediate annealing as described above.

Finally, the final annealing of the rolled material may be performed.

The final annealing of the rolled material may be performed in a temperature range of 350 to 500° C.

Specifically, the final annealing may be performed for 30 to 600 min.

Recrystallization may easily occur by performing the final annealing under the above conditions.

Hereinafter, the details will be described with reference to examples. The following examples are illustrative of the present invention and are not intended to limit the scope of the present invention.

Examples

First, a molten alloy satisfying components and compositions shown in Table 1 below was prepared.

Thereafter, the molten alloy was cast by a strip casting method to prepare a cast material.

The cast material was subjected to homogenizing at 450° C. for 24 hours.

Then, the homogenized casting material was rolled at 300° C., and in this case, the reduction ratio was 18% per pass. Specifically, when rolling was performed twice or more, intermediate annealing was performed. More specifically, the rolling and the intermediate annealing were performed under the conditions described in the following Table 2. In this case, the intermediate annealing was performed at 450° C. in the same manner, and only frequencies of rolling and intermediate annealing were different.

Thereafter, the rolled material was subjected to the final annealing at 400° C. for 1 hour.

As a result, physical properties of the formed magnesium alloy sheet material are as shown in Table 2 below.

<Moldability Measurement Method at Room Temperature>

In this case, a method of measuring Ericson values at room temperature is as follows.

A magnesium alloy sheet was inserted between an upper die and a lower die, and then an external circumferential portion of the sheet was fixed with a force of 20 kN. Thereafter, the sheet was deformed at a rate of 5 to 20 mm/min using a spherical punch having a diameter of 20 mm. The punch was inserted until the plate was broken, and a deformation height of the plate was measured at the time of breaking.

TABLE 1

| Division | Name | Al (wt %) | Zn (wt %) | Ca (wt %) | Mg (wt %) |
|---|---|---|---|---|---|
| Inventive Material 1 | AZX110.7 | 1 | 1 | 0.7 | Bal. |
| Inventive Material 2 | AZX211 | 2 | 1 | 1 | Bal. |
| Inventive Material 3 | AZX210.7 | 2 | 1 | 0.7 | Bal. |
| Comparative Material 1 | AZX311 | 3 | 1 | 1 | Bal. |
| Comparative Material 2 | AZX112, 212 | 1 | 1 | 2 | Bal. |

TABLE 2

| Division | Name | Number of Intermediate Annealing | Yield Strength (MPa) | Tensile Strength (Mpa) | Elongation (%) | Ericsson value (mm) |
|---|---|---|---|---|---|---|
| Example 1 | Inventive | 0 | 166 | 237 | 20 | 4.5 |
| Example 2 | Material 1 (AZX110.7) | 1/8 | 164 | 235 | 25 | 8.3 |
| Example 3 | Inventive | 0 | 174 | 250 | 14 | 6.2 |
| Example 4 | Material 2 (AZX211) | 1/8 | 163 | 248 | 24 | 7.7 |
| Example 5 | Inventive | 0 | 167 | 250 | 16 | 6.5 |
| Example 6 | Material 3 | 1/8 | 161 | 249 | 25 | 8.1 |
| Example 7 | (AZX210.7) | 1/7 | 160 | 249 | 28 | 9.8 |
| Comparative Example 1 | Comparative Material 1 | 0 | 235 | 288 | 10 | 3.8 |
| Comparative Example 2 | (AZX311) | 1/7 | 189 | 266 | 15 | 4.0 |
| Comparative Example 3 | Comparative Material 2 (AZX112, 212) | 1/3-1/2 | 134 | 221 | 3 | 3-4 |

Table 2 shows physical properties of the magnesium alloy sheet using an inventive material satisfying components, and a composition of the magnesium alloy sheet and a comparative material not satisfying the same, according to the exemplary embodiment of the present invention.

Specifically, it can be seen that moldability is remarkably high in the case of Comparative Examples 1 to 3 in which a magnesium alloy sheet was formed using Comparative Material 1 in which aluminum was excessively added, as compared with Examples 3 and 4 only having a different aluminum composition.

In addition, in Comparative Example 3 in which a magnesium alloy sheet was formed using Comparative Material 2 in which calcium was excessively added, the moldability was remarkably deteriorated compared to Examples 1 to 7. Therefore, when calcium is excessively added as in Comparative Example 3, a large number of cracks are generated during rolling, and moldability and mechanical properties may be deteriorated.

Specifically, in the case of Examples 1 to 7, which satisfy all the components and the composition of the magnesium alloy sheet and the frequency of intermediate annealing according to the exemplary embodiment of the present invention, it can be seen that even when the intermediate annealing is not performed (Example 1), an Erickson value of at least 4.5 mm is exhibited, which is superior in moldability to the comparative example (Comparative Example 3) in which the intermediate annealing is performed. In other words, excellent moldability is confirmed even though the frequency of intermediate annealing was lower than that of the comparative examples.

This may also be confirmed through the drawings.

Figure 2:
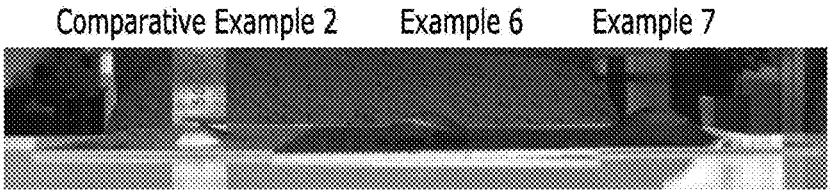
FIG. 2 illustrates comparison results of an Ericsson test at room temperature according to Comparative Example 2, Example 6, and Example 7.

FIG. 2 shows comparison results of an Ericsson test at the room temperature according to Comparative Example 2, Example 6, and Example 7.

As illustrated in FIG. 2, compared with Example 7, in Comparative Example 2, only the aluminum content did not satisfy the range according to the exemplary embodiment of the present invention. The magnesium alloy sheet was manufactured under the same condition for the frequency of intermediate annealing. As a result, as illustrated FIG. 2, it can be visually confirmed that the deformation height of Comparative Example 2 is significantly smaller than that of Example 7.

In addition, it can be confirmed that the deformation height of the magnesium alloy sheet in Comparative Example 2 is smaller than that in Example 6 in which the frequency of intermediate annealing is small. As a result, it can be visually confirmed that the moldability of the examples is excellent.

Figure 3:
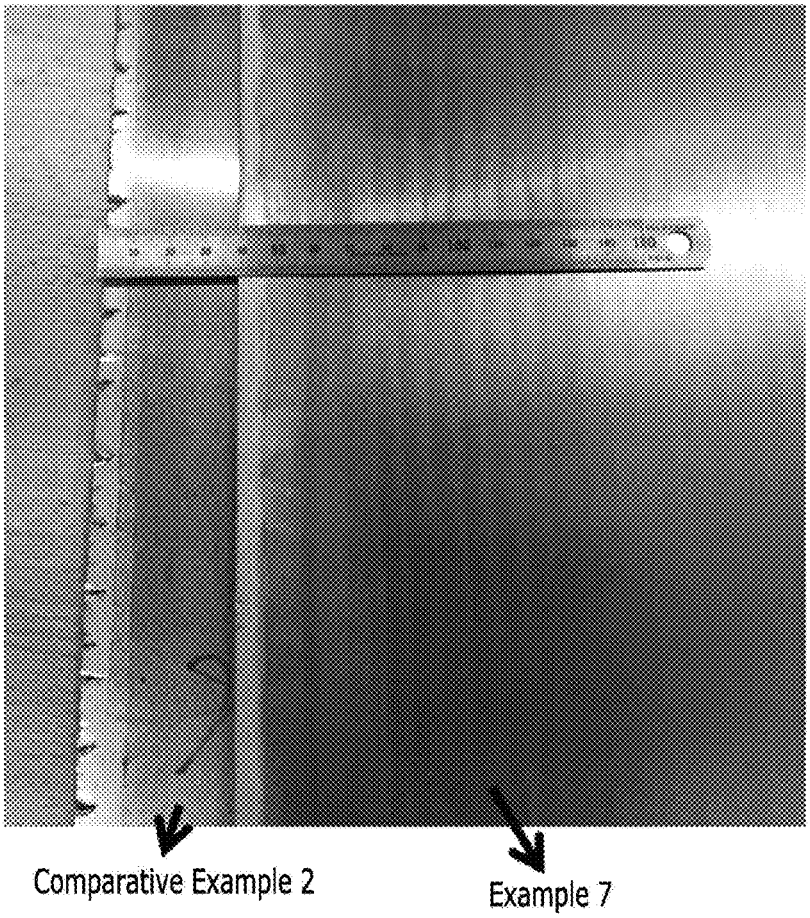
FIG. 3 illustrates surface edge cracks of a magnesium alloy sheet manufactured according to Comparative Example 2 and Example 7.

In addition, it can be confirmed from FIG. 3 that surface defects in Comparative Example 2 are also deteriorated as compared with those in Example 7.

FIG. 3 illustrates a comparison of surface edge cracks of a magnesium alloy sheet manufactured by according to Comparative Example 2 and Example 7.

In Comparative Example 2, only the aluminum composition according to the exemplary embodiment of the present invention was not satisfied, and the magnesium alloy sheet was manufactured under the same conditions as in Example 7. Specifically, in Comparative Example 2 and Example 7, the intermediate annealing was carried out under the same conditions when the reduction ratio was 80% or more, to manufacture the magnesium alloy sheet. As a result, a surface of Example 7 had a very small number of edge cracks, while a surface of Comparative Example 2 had surface edge cracks that could be visually confirmed.

Accordingly, it can be seen that the number of edge cracks with respect to an area of the magnesium alloy sheet which has been final-annealed according to the exemplary embodiment of the present invention is 1 per 50 $cm^2$ or less.

Figure 4:
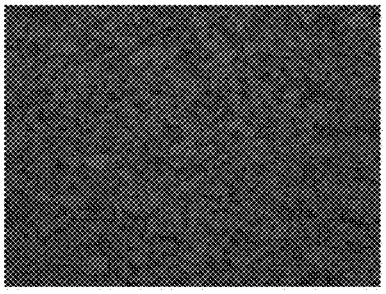
FIG. 4 illustrates microtextures of a rolled material and a magnesium alloy sheet according to Example 7.
Figure 4:
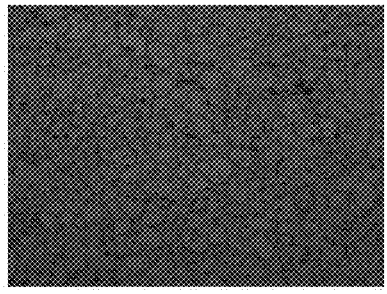

FIG. 4 illustrates microtextures of a rolled material and a magnesium alloy sheet according to Example 7.

As shown in FIG. 4, it can be confirmed that a large amount of twin texture and second phase texture are distributed throughout the rolled material of Example 7. On the other hand, in the magnesium alloy sheet of Example 7 which was final-annealed by the final annealing according to the exemplary embodiment of the present invention, most of the twin texture was annihilated, and a new crystal grain was formed therefrom.

Figure 5:
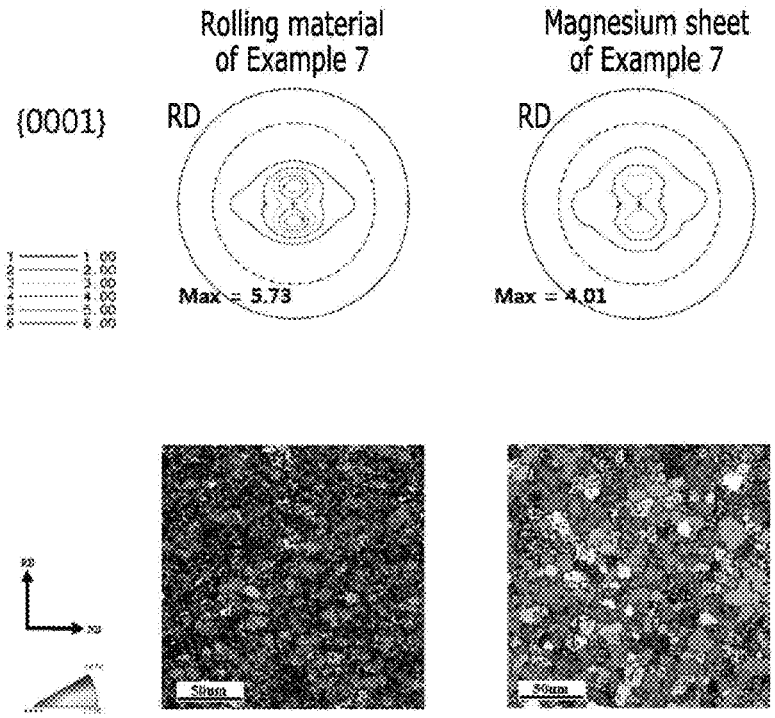
FIG. 5 illustrates results of XRD observation of a change in texture of a {0001} plane in a rolled material and a magnesium alloy sheet according to Example 7 and an inverse pole figure (IPF) map through electron backscatter diffraction (EBSD).

This may also be confirmed through FIG. 5.

FIG. 5 illustrates results of XRD observation of a change in texture of a {0001} plane in a rolled material and a magnesium alloy sheet according to Example 7, and an inverse pole figure (IPF) map through electron backscatter diffraction (EBSD).

As shown in FIG. 5, it can be seen that a large number of recrystallized non-basal grains deviating from a basal orientation were formed in the magnesium alloy sheet material of Example 7 as compared with the rolled material of Example 7. As a result, it can be seen that a peak intensity value is lower than that of the rolled material.

It can also be confirmed from the EBSD that the distribution of the recrystallized non-basal grains was increased in the case of the magnesium alloy sheet of Example 7 as compared with the rolled material of Example 7. In other words, it can be seen that the magnesium alloy sheet finally annealed according to the exemplary embodiment of the present invention has an area fraction of 50% or more of the recrystallized non-basal grains, as compared with a total area of 100%.

Figure 6:
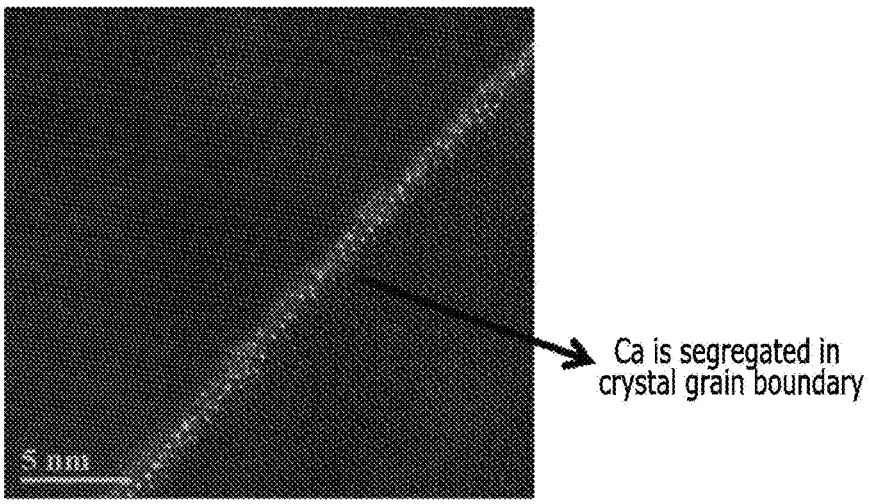
FIG. 6 illustrates a state in which calcium is segregated in a form of a solute in crystal grain boundaries of Example 7.

FIG. 6 illustrates a state in which calcium is segregated in a form of a solute in crystal grain boundaries of Example 7.

This is because, as calcium is segregated in the crystal grain boundaries in a form as disclosed in FIG. 6, boundary mobility is lowered, to facilitate forming the recrystallized non-basal grains.

Accordingly, it is possible to obtain a magnesium alloy sheet material having excellent formability even when the frequency of intermediate annealing is low, by controlling the components of aluminum and calcium according to the exemplary embodiment of the present invention. Therefore, it is possible to provide a manufacturing method of a magnesium alloy sheet capable of mass production and capable of reducing the process cost in mass production.

While the exemplary embodiments of the present invention have been described hereinbefore with reference to the accompanying drawings, it will be understood by those skilled in the art that various changes in form and details may be made thereto without departing from the technical spirit and essential features of the present invention.

Therefore, it is to be understood that the above-described exemplary embodiments are for illustrative purposes only and the scope of the present invention is not limited thereto. The scope of the present invention is determined not by the above description, but by the following claims, and all changes or modifications from the spirit, scope, and equivalents of claims should be construed as being included in the scope of the present invention.

The invention claimed is:

1. A magnesium alloy sheet comprising:

0.5 to 2.1 wt % of Al, 0.5 to 1.5 wt % of Zn, 0.1 to 1.0 wt % of Ca, and a balance of Mg and inevitable impurities, with respect to a total of 100 wt % of the magnesium alloy sheet, wherein the magnesium alloy sheet has an Erickson value of 7.7 mm to 9.8 mm at room temperature.

2. The magnesium alloy sheet of claim 1, further comprising 1 wt % or less of Mn with respect to the total of 100 wt % of the magnesium alloy sheet.

3. The magnesium alloy sheet of claim 2, wherein the magnesium alloy sheet has a calcium element segregated at grain boundaries.

4. The magnesium alloy sheet of claim 3, wherein

An area fraction of a non-basal grain is 20% or more with respect to a total area of 100% of the magnesium alloy sheet.

5. The magnesium alloy sheet of claim 4, wherein a microtexture of the magnesium alloy sheet has a particle diameter of 5 to 20 μm.

6. The magnesium alloy sheet of claim 5, wherein the magnesium alloy sheet has a twin texture or a second phase, and an area fraction of the twin structure or the second phase is 0 to 30% with respect to the total area of 100% of the magnesium alloy sheet.

7. A manufacturing method of a magnesium alloy sheet of claim 1, the method comprising:

preparing a molten alloy containing 0.5 to 2.1 wt % of Al, 0.5 to 1.5 wt % of Zn, 0.1 to 1.0 wt % of Ca, and a balance of Mg and inevitable impurities, with respect to a total of 100 wt % of the molten alloy;

preparing a casting material by casting the molten alloy;

preparing a rolled material by rolling the casting material; and final annealing of the rolled material, wherein the preparing of the rolled material by rolling the casting material includes intermediate annealing of the rolled material, wherein during the intermediate annealing of the rolled material, a frequency of intermediate annealing is in a range of ⅙ to ⅛, and wherein the frequency of intermediate annealing equals the number of intermediate annealing/total number of rolling.

8. The manufacturing method of claim 7, wherein in the preparing of the rolled material by rolling the casting material, rolling is performed at a reduction ratio of 50% or less (excluding 0%) per rolling.

9. The manufacturing method of claim 8, wherein in the preparing of the rolled material by rolling the casting material, the casting material is rolled once, twice, or more.

10. The manufacturing method of claim 9, wherein in the preparing of the rolled material by rolling the casting material, the rolling is performed in a temperature range of 200 to 350° C.

11. The manufacturing method of claim 10, wherein the preparing of the rolled material by rolling the casting material includes intermediate annealing of the rolled material.

12. The manufacturing method of claim 11, wherein in the intermediate annealing of the rolled material, a number of intermediate annealing is in a range of ⅙ to ⅛, wherein the number of intermediate annealing=number of intermediate annealing/total number of rolling.

13. The manufacturing method of claim 12, wherein in the intermediate annealing of the rolled material, the intermediate annealing is performed at a cumulative reduction ratio of 50% or more of the rolled material.

14. The manufacturing method of claim 13, wherein in the intermediate annealing of the rolled material, the intermediate annealing is performed in a temperature range of 300 to 500° C.

15. The manufacturing method of claim 14, wherein in the intermediate annealing of the rolled material, the intermediate annealing is performed for 30 to 600 min.

16. The manufacturing method of claim 7, wherein in the final annealing of the rolled material, the final annealing is performed in a temperature range of 350 to 500° C.

17. The manufacturing method of claim 16, wherein in the final annealing of the rolled material, the final annealing is performed for 30 to 600 min.

* * * * *